US011725641B2

(12) United States Patent
Howseman, Jr.

(10) Patent No.: US 11,725,641 B2
(45) Date of Patent: Aug. 15, 2023

(54) DOUBLE-ACTING RECIPROCATING PUMP ASSEMBLY FOR USE IN CONJUNCTION WITH A MELTER

(71) Applicant: William E. Howseman, Jr., Ojai, CA (US)

(72) Inventor: William E. Howseman, Jr., Ojai, CA (US)

( * ) Notice: Subject to any disclaimer, the term of this patent is extended or adjusted under 35 U.S.C. 154(b) by 16 days.

(21) Appl. No.: 17/084,473

(22) Filed: Oct. 29, 2020

(65) Prior Publication Data

US 2022/0136491 A1 May 5, 2022

(51) Int. Cl.

| | |
|---|---|
| ***F04B 19/22*** | (2006.01) |
| ***F04B 49/22*** | (2006.01) |
| ***F04B 53/10*** | (2006.01) |
| ***F04B 53/14*** | (2006.01) |
| ***F04B 39/00*** | (2006.01) |
| ***F04B 23/02*** | (2006.01) |
| ***F04B 15/04*** | (2006.01) |
| ***F04B 41/02*** | (2006.01) |
| ***F04B 53/12*** | (2006.01) |
| ***F04B 5/02*** | (2006.01) |

(52) U.S. Cl.

CPC ..... *F04B 19/22* (2013.01); *F04B 49/22* (2013.01); *F04B 53/1002* (2013.01); *F04B 53/14* (2013.01); *F04B 5/02* (2013.01); *F04B 15/04* (2013.01); *F04B 23/028* (2013.01); *F04B 39/0016* (2013.01); *F04B 39/0022* (2013.01); *F04B 41/02* (2013.01); *F04B 53/101* (2013.01); *F04B 53/1005* (2013.01); *F04B 53/109* (2013.01); *F04B 53/1087* (2013.01); *F04B 53/126* (2013.01)

(58) Field of Classification Search

CPC ..... F04B 19/22; F04B 49/22; F04B 53/1002; F04B 53/14; F04B 5/02; F04B 15/04; F04B 23/021; F04B 23/023; F04B 23/028; F04B 39/0016; F04B 39/0022; F04B 41/02; F04B 53/1005; F04B 53/101; F04B 53/1087; F04B 53/109; F04B 53/12; F04B 53/126; F04B 53/148

See application file for complete search history.

(56) References Cited

U.S. PATENT DOCUMENTS

| | | | | |
|---|---|---|---|---|
| 171,392 A | | 12/1875 | Doren | |
| 530,350 A | | 12/1894 | Rosenkranz | |
| 2,413,044 A | * | 12/1946 | Grise | F04B 23/023 417/264 |

(Continued)

*Primary Examiner* — Kenneth J Hansen
*Assistant Examiner* — David N Brandt
(74) *Attorney, Agent, or Firm* — Law Offices of Steven W. Weinrieb

(57) ABSTRACT

A double-acting reciprocating pump comprises a piston assembly comprising at least one piston disposed within at least one piston cylinder for undergoing opposite reciprocal movements within said at least one piston cylinder, an upper pump chamber disposed above the piston, and a lower pump chamber disposed below the piston. A fluid inlet is fluidically connected to one of the upper and lower pump chambers so as to supply fluid thereto, and a fluid outlet dispensing port is defined within a lower end portion of the double-acting reciprocating pump assembly for permitting fluid to be dispensed out from the double-acting reciprocating pump assembly during both of the opposite reciprocal movements.

7 Claims, 7 Drawing Sheets

(56) References Cited

U.S. PATENT DOCUMENTS

| | | | | |
|---|---|---|---|---|
| 2,895,421 | A | 7/1959 | Peeps | |
| 2,954,737 | A | 10/1960 | Hoover | |
| 3,366,066 | A | 1/1968 | Levey | |
| 3,583,837 | A | 6/1971 | Rolsten | |
| 3,635,125 | A | 1/1972 | Rosen et al. | |
| 3,827,339 | A | 8/1974 | Rosen et al. | |
| 4,030,857 | A | 6/1977 | Smith, Jr. | |
| 4,346,849 | A | 8/1982 | Rood | |
| 4,509,903 | A | 4/1985 | Fram | |
| 4,859,073 | A | 8/1989 | Howseman, Jr. et al. | |
| 5,435,697 | A | 7/1995 | Guebeli et al. | |
| 5,647,737 | A * | 7/1997 | Gardner | F04B 53/22 417/454 |
| 5,671,656 | A | 9/1997 | Cyphers | |
| 5,984,646 | A | 11/1999 | Renfro et al. | |
| 6,558,141 | B2 | 5/2003 | Vonalt et al. | |
| 6,619,316 | B2 | 9/2003 | Wiechers et al. | |
| 7,296,981 | B2 | 11/2007 | Strong | |
| 1,616,201 | A1 | 2/2023 | Shearer | |
| 1,263,201 | A1 | 4/2023 | Brown | |
| 2014/0203040 | A1 * | 7/2014 | Clark | B05C 11/1042 222/54 |

* cited by examiner

DOUBLE-ACTING RECIPROCATING PUMP ASSEMBLY FOR USE IN CONJUNCTION WITH A MELTER

FIELD OF THE INVENTION

The present invention relates generally to pump assemblies, and more particularly to a double-acting reciprocating pump assembly for dispensing a fluid comprising a piston assembly comprising at least one piston disposed within at least one piston cylinder for undergoing opposite reciprocal movements within the at least one piston cylinder, an upper pump chamber disposed above the at least one piston, a lower pump chamber disposed below the at least one piston, a fluid inlet port fluidically connected to a material supply and fluidically connected to one of the upper and lower pump chambers so as to supply fluid, to be dispensed, to one of the upper and lower pump chambers, and a fluid outlet dispensing port defined within a lower end portion of the double-acting reciprocating pump assembly for permitting fluid to be dispensed out from the double-acting reciprocating pump assembly in equal amounts during both of the opposite reciprocal movements.

BACKGROUND OF THE INVENTION

Reciprocating pumps are of course well known in the art of dispensing a variety of different fluids. Examples of known reciprocating pumps assemblies for dispensing fluids can be appreciated as a result of reference being made to U.S. Pat. No. 7,296,981 which issued to Strong on Nov. 20, 2007; U.S. Pat. No. 6,619,316 which issued to Wiechers et al. on Sep. 16, 2003; U.S. Pat. No. 6,558,141 which issued to Vonalt et al. on May 6, 2003; U.S. Pat. No. 5,984,646 which issued to Renfro et al. on Nov. 16, 1999; U.S. Pat. No. 5,671,656 which issued to Cyphers et al. on Sep. 30, 1997; U.S. Pat. No. 5,647,737 which issued to Gardner et al. on Jul. 15, 1997; U.S. Pat. No. 5,435,697 which issued to Guebeli et al. on Jul. 25, 1995; U.S. Pat. No. 4,509,903 which issued to Fram on Apr. 9, 1985; U.S. Pat. No. 4,386,849 which issued to Rood on Aug. 31, 1982; U.S. Pat. No. 4,030,857 which issued to Smith, Jr. on Jun. 21, 1977; U.S. Pat. No. 3,827,339 which issued to Rosen et al. on Aug. 6, 1974; U.S. Pat. No. 3,635,125 which issued to Rosen et al. on Jan. 18, 1972; U.S. Pat. No. 3,583,837 which issued to Rolsten on Jun. 8, 1971; U.S. Pat. No. 3,366,066 which issued to Levey on Jan. 30, 1968; U.S. Pat. No. 2,954,737 which issued to Hoover on Oct. 4, 1960; U.S. Pat. No. 2,895,421 which issued to Peeps on Jul. 21, 1959; U.S. Pat. No. 1,616,201 which issued to Shearer on Feb. 1, 1927; U.S. Pat. No. 1,263,201 which issued to Brown on Apr. 16, 1918; U.S. Pat. No. 530,350 which issued to Rosenkranz on Dec. 4, 1894; and U.S. Pat. No. 171,592 which issued to Van Doren on Dec. 28, 1875.

In certain industries, it is often desirable to dispense a composition wherein the composition may be fabricated from several different ingredients or constituents, and more particularly, wherein, in order to achieve specific objectives, the composition may exhibit particularly desirable characteristics such as, for example, strength, softness or hardness, fluidity, viscosity, durability, and the like. Furthermore, it has been experienced that with the known reciprocating pumps, while leakage of the fluid being pumped and dispensed will often occur, the leakage occurs at external locations of the pump assemblies which adversely affect the continuous operations of the pump assemblies, thereby necessitating repair or replacement of the pump seal structures, or clean-up maintenance procedures with respect to the overall pump assembly, to be implemented which, again, results in the loss of valuable production time due to the necessity of performing such repair or replacement or clean-up maintenance procedures. Still further, as disclosed within U.S. Pat. No. 4,859,073, which issued to Howseman, Jr. et al. on Aug. 22, 1989, while such patent discloses a pump outlet which is located within the lower end portion of the pump assembly, this is only rendered structurally possible because the pump assembly comprises a single-acting pump assembly wherein the single-acting pump only pumps fluid out from the pump assembly during the downstroke of the pump. In other words, a double-acting pump assembly, wherein fluid is pumped out from a single pump outlet which is located within the lower end portion of the pump assembly during both the upstroke and downstroke of the pump assembly, would not be possible in accordance with the teachings of the noted patent.

A need therefore exists in the art for a new and improved double-acting reciprocating pump assembly. An additional need exists in the art for a new and improved double-acting reciprocating pump assembly which is relatively simple in structure. A further need exists in the art for a new and improved double-acting reciprocating pump assembly which is relatively simple in structure and which can pump and dispense equal amounts of fluid during both the UP and DOWN working strokes of the pump piston assembly. A yet further need exists in the art for a new and improved double-acting reciprocating pump assembly wherein the fluid inlet ports or inlet valves, as well as that portion of the pump piston rod assembly operatively and fluidically associated with the fluid inlet ports or inlet valves, are disposed internally within the material supply chamber, from which the fluid is to be pumped and ultimately dispensed, such that if any leakage occurs, such leakage will not foul other operational components of the pump assembly, or will not flow outward from the material supply chamber so as to foul external portions of the material supply chamber, but, to the contrary, will simply become part of the overall fluid existing within the material supply chamber from which the fluid is to be pumped and ultimately dispensed. A still yet further need exists in the art for a new and improved double-acting reciprocating pump assembly wherein the fluid outlet port of the double-acting reciprocating pump assembly will be disposed within the lower end portion of the double-acting reciprocating pump assembly.

OVERALL OBJECTIVES OF THE INVENTION

An overall objective of the present invention is to provide a new and improved double-acting reciprocating pump assembly. An additional overall objective of the present invention is to provide a new and improved double-acting reciprocating pump assembly which is relatively simple in structure. A further overall objective of the present invention is to provide a new and improved double-acting reciprocating pump assembly which is relatively simple in structure and which can pump and dispense equal amounts of fluid both during the UP and DOWN working strokes of the pump piston assembly. A yet further overall objective of the present invention is to provide a new and improved double-acting reciprocating pump assembly wherein the fluid inlet ports or inlet valves, as well as that portion of the pump piston rod assembly operatively and fluidically associated with the fluid inlet ports or inlet valves, are disposed internally within the material supply chamber, from which the fluid is to be pumped and ultimately dispensed, such that if any leakage occurs, such leakage will not foul other operational components of the pump assembly, or will not flow outward from the material supply chamber so as to foul external portions of the material supply chamber, but, to the contrary, will simply become part of the overall fluid existing within the material supply chamber from which the fluid is to be pumped and ultimately dispensed. A still yet further overall objective of the present invention is to provide a new and improved double-acting reciprocating pump assembly wherein the fluid outlet port of the double-acting reciprocating pump assembly will be disposed within the lower end portion of the double-acting reciprocating pump assembly.

SUMMARY OF THE INVENTION

The foregoing and other objectives are achieved in accordance with the principles and teachings of a first embodiment of the present invention through the provision of a new and improved double-acting reciprocating pump assembly which is operatively associated with a melter that houses a fluid to be pumped and dispensed. More particularly, the piston-cylinder assembly comprises a lower pump cylinder within which a lower pump piston is reciprocally movable within a lower pump chamber defined by the lower pump cylinder, and an upper pump cylinder which is fixedly connected to the lower pump cylinder and within which an upper pump piston is reciprocally movable within an upper pump chamber defined by the upper pump cylinder. The upper pump piston is fixedly secured to a vertically oriented piston rod, which is fixedly connected to a motor rod, of a drive motor for driving the pump assembly in a vertically reciprocal manner, by means of a suitable intermediate connecting rod, the motor being either pneumatic, electric, or hydraulic. The lower end portion of the piston rod is, in turn, fixedly secured within the lower pump piston such that the lower pump piston, the upper pump piston, the piston rod, the connecting rod, and the motor rod all move in unison. A plurality of upper inlet ball check valve assemblies are operatively connected to the upper end of the upper pump cylinder and are fluidically connected to an annular material supply chamber which, in turn, is fluidically connected to the melter. The plurality of upper inlet ball check valve assemblies include a plurality of inlet ball check valves which are respectively movably disposed within upper inlet ball check valve cages which, respectively, include upper inlet ball check valve seats, while a lower outlet ball check valve assembly is disposed within a lower end portion of the lower pump piston and comprises a lower outlet ball check valve disposed within a lower ball check valve cage which also comprises a lower ball check valve seat. A material dispensing outlet port is fluidically connected to the lower end of the lower pump chamber and is adapted to be connected to any suitable dispensing device such that when the lower outlet ball check valve is seated upon its valve seat, material can flow out the material dispensing outlet port and be dispensed by means of the dispensing device.

In operation, and as will become better understood hereinafter when reference is made to the attached drawings, as the piston assembly moves downwardly such that the lower pump piston moves vertically downwardly within the lower pump chamber defined by means of the lower pump cylinder, the lower pump piston will force material, disposed beneath the lower pump piston within the lower pump chamber defined by means of the lower pump cylinder, to be dispensed out from the material dispensing outlet port. At the same time, pressure developed within the lower pump chamber, as a result of the lower pump piston moving vertically downwardly within the lower pump chamber defined by means of the lower pump cylinder, causes the lower ball check valve to be seated upon its upper ball check valve seat. In addition, the upper pump piston is likewise moving vertically downwardly within the upper pump chamber as defined by means of the upper pump cylinder. Accordingly, such vertically downward movement of the upper pump piston within the upper pump chamber effectively causes vacuum or suction forces to be developed within the upper pump chamber so as to cause the plurality of upper ball check valves to be unseated from respective ones of their ball check valve seats, thereby permitting material, to be dispensed, to flow into the upper pump chamber from the material supply chamber which annularly surrounds the upper pump cylinder and is fluidically connected to the melter. When the piston assembly reaches the end of its down stroke, the drive motor reverses the operation of the piston assembly whereby the upper and lower pistons are now moved upwardly.

The piston rod, to which the upper pump piston is fixedly connected, is provided with a plurality of outlet holes or ports which are disposed within an annular array at an axial position along the piston rod which is disposed immediately above the axial position at which the upper pump piston is fixedly connected to the piston rod. Accordingly, as the upper pump piston moves upwardly within the upper pump chamber, pressure is developed within the upper pump chamber so as to cause the upper inlet ball check valves to be seated upon their upper inlet ball check valve seats. Therefore, the only place the material, disposed within upper pump chamber, can go or flow, is through the plurality of outlet holes or ports defined around the piston rod. In addition, a first vertically oriented axial bore is defined within the lower end portion of the piston rod and is fluidically connected to a second vertically oriented axial bore defined within the lower pump piston. This second vertically oriented axial bore, defined within the lower pump piston, terminates at where the lower outlet ball check valve is located, and accordingly, the material to be dispensed unseats the lower outlet ball check valve such that the material to be dispensed can flow out from the material dispensing outlet port.

It is to be noted that the square surface area of the upper face of the upper pump piston, operating upon the fluid material disposed within the upper pump chamber during the upstroke of the piston assembly, is twice the size of the square surface area of the lower face of the lower pump piston operating upon the fluid material disposed within the lower pump chamber during the downstroke of the piston assembly. This permits the same volume of material to be dispensed from the pump assembly during both the up and down strokes of the pump assembly because during the upstroke of the piston assembly, one half of the material forcefully discharged from the upper pump chamber is eventually dispensed out from the material dispensing outlet port while the other half of the material effectively refills the lower pump chamber as the lower pump piston is retracted upwardly within the lower pump chamber. It is further noted that since the plurality of inlet ball check valves are fluidically connected to the material supply chamber annular surrounding the upper pump cylinder and the plurality of inlet ball check valves, any leakage of material that may occur from the upper piston-cylinder assembly effectively occurs within the material supply chamber whereby such leaked fluid will effectively be contained within the annular material supply chamber so as not to cause any external leakage problems which may adversely affect other structural components of the overall melter assembly. It is lastly noted that the new and improved double-acting reciprocating pump assembly of the present invention can be utilized to pump and dispense both hot and cold materials which, in the case of hot materials, the fluids can be at temperatures of up to 500° F.

In accordance with a second embodiment of the present invention, while the overall operation of the second embodiment of the present invention is generally similar to the overall general operation of the first embodiment of the present invention, the structural assembly of the second embodiment of the present invention is somewhat different from the structural assembly of the first embodiment of the present invention. More particularly, the entire piston assembly is disposed within the melter and there is only a single piston fixedly secured to a piston rod whereby the piston moves reciprocally within a piston cylinder so as to effectively divide the cylinder into an upper pump chamber and a lower pump chamber. An upper ball check valve is disposed within the piston and has upper and lower ball check valve seats operatively associated therewith, while a lower ball check valve is disposed within a bottom portion of the piston-cylinder assembly and likewise has upper and lower ball check valve seats operatively associated therewith. When the piston moves downwardly, the lower ball check valve is seated upon its lower check ball valve seat due to the downward pressure exerted upon the fluid disposed within the lower pump chamber, while the fluid, to be dispensed, simultaneously forces the upper ball check valve to be unseated from its lower check ball valve seat and seated upon its upper check ball valve seat whereby the fluid can flow around the unseated upper ball check valve, into cross-channels defined within the piston rod, out through outlet ports defined within upper end portions of the piston cylinder, and through an annular passageway defined around the piston cylinder which leads to a fluid dispensing outlet port.

Conversely, when the piston moves upwardly, the lower ball check valve, fluidically connected to the interior of the miter, will be unseated from its lower ball check valve seat so as to permit fluid to enter the lower pump chamber, while the upper ball check valve will be forced to be seated upon its lower check ball valve seat as a result of the pressure developed within the upper pump chamber when the piston is moving upwardly. The fluid within the upper pump chamber is then forced out through the aforenoted cross-channels defined within the piston rod, as well as the outlet ports defined within the piston cylinder, so as to enter the annular passageway surrounding the piston cylinder such that the fluid can be dispensed through the fluid dispensing outlet port. As was the case with the first embodiment, it is noted that the square surface area of the lower face of the pump piston is twice the size of the square surface area of the upper face of the pump piston which effectively merges with the piston rod. In this manner, when the piston is moving downwardly, half of the fluid being forced outwardly from the lower pump chamber flows around the unseated upper ball check valve, through the aforenoted cross-channels defined within the piston rod, as well as the outlet ports defined within the piston cylinder, through the annular passageway surrounding the piston cylinder, and out through the fluid dispensing outlet port, while the other half of the fluid is effectively utilized to refill the upper pump chamber. This permits the same volume of material to be dispensed from the pump assembly during both the up and down strokes of the piston assembly.

In accordance with a third embodiment of the present invention, it is again noted that while the overall operation of the third embodiment of the present invention is generally similar to the overall general operation of the first and second embodiments of the present invention, the structural assembly of the third embodiment of the present invention is somewhat different from the structural assemblies of the first and second embodiments of the present invention. More particularly, the structural assembly of the third embodiment of the present is somewhat similar to the structural assembly of the first embodiment except for the fact that the upper ball check valves have been eliminated, however, again, this third embodiment of the present invention, like the first embodiment of the present invention, utilizes an upper pump piston disposed within an upper pump cylinder defining an upper pump chamber, and a lower pump piston disposed within a lower pump cylinder which defines a lower pump chamber.

Also, in a manner similar to that of the first embodiment of the present invention, the upper pump piston is fixedly attached to a piston rod which is, in turn, fixedly connected to a motor rod of a drive motor, through means of an intermediary connecting rod, which drives the pump assembly in a vertically reciprocal manner, and the lower end portion of the piston rod is fixedly connected to the upper end portion of the lower pump piston. Again, the drive motor may be pneumatic, electric, or hydraulic. In addition, an annular array of fluid inlet ports are formed within the lower part of the upper piston cylinder such that the interior of the upper piston cylinder, and therefore the upper pump chamber defined by the upper piston cylinder, is in fluidic communication with the material supply chamber annularly surrounding the upper piston cylinder. As was the case with the first embodiment of the present invention, a ball check valve is disposed within a lower end portion of the lower pump piston and comprises a lower outlet ball check valve disposed within a lower ball check valve cage which also comprises a lower ball check valve seat. A material dispensing outlet port is fluidically connected to the lower end of the lower pump chamber and is adapted to be connected to any suitable dispensing device such that when the lower outlet ball check valve is seated upon its valve seat, material can flow out the material dispensing outlet port and be dispensed by means of the dispensing device.

When the piston assembly moves downwardly, the lower ball check valve is seated upon its valve seat due to the pressure exerted upon the fluid disposed within the lower pump chamber by the lower pump piston, while at the same time, the fluid disposed within the lower pump chamber is forced out through the fluid dispensing output port. As the piston assembly nears the end of its downward stroke, the upper pump piston clears the fluid inlet ports such that fluid can now enter the upper pump chamber so as to refill the same with fluid to be dispensed. Accordingly, as the piston assembly begins its upward stroke, the upper pump piston closes off the annular array of fluid inlet ports and forces the fluid disposed within the upper pump chamber to enter an annular array of fluid outlet ports defined within the piston rod, the fluid outlet ports are fluidically connected to an axial passageway defined within the lower pump piston, the fluid flowing through the axial passageway causes the lower ball check valve to be unseated, and the fluid is forced out from the dispensing outlet port.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
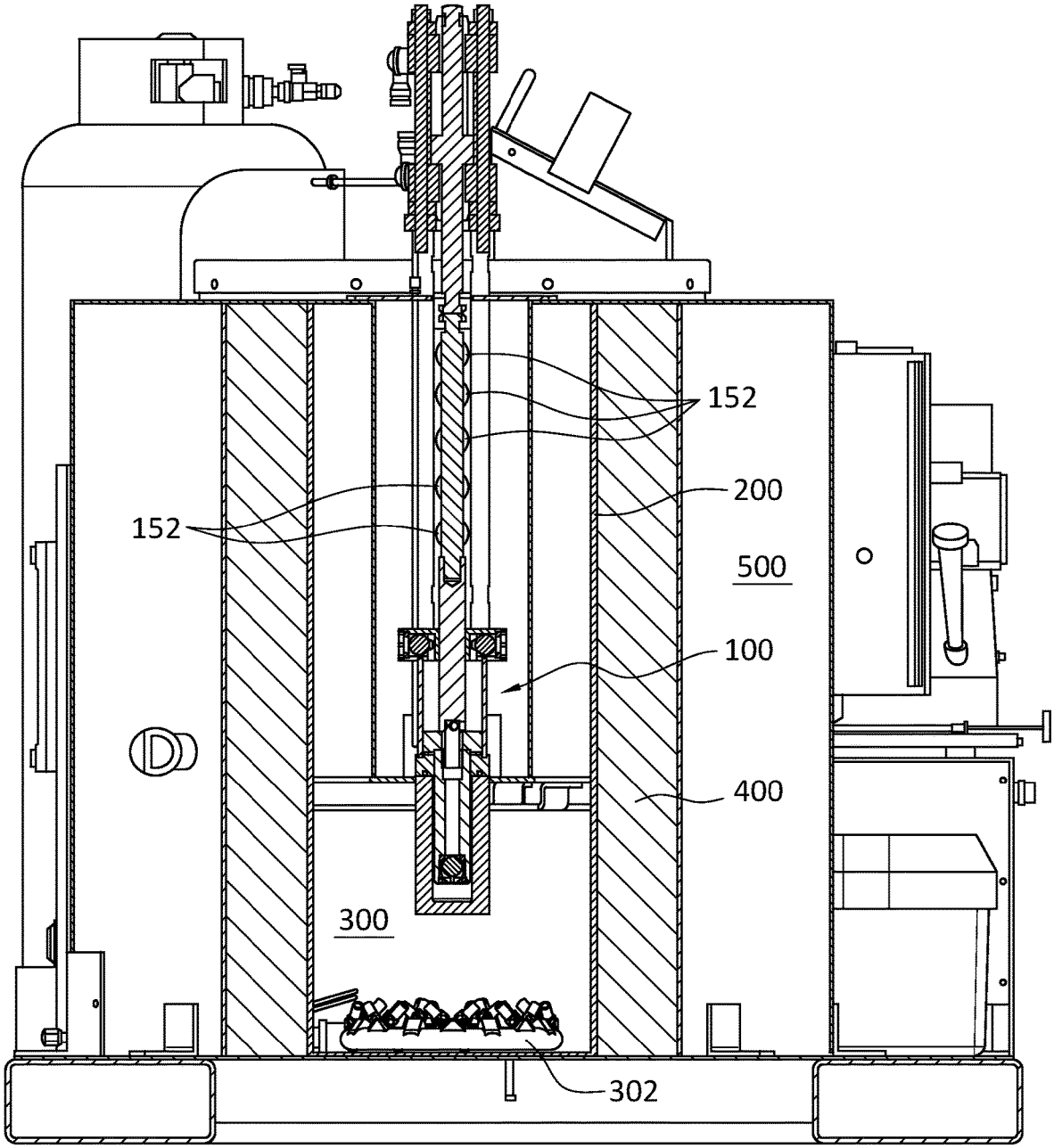
FIG. 1 is a front elevational, vertical cross-sectional view of a melter assembly disclosing the melter section of the melter assembly disposed above the combustion chamber of the melter assembly and a first embodiment of a new and improved double-acting reciprocating pump assembly, as constructed in accordance with the principles and teachings of the present invention, wherein the piston assembly is shown in its DOWN position, and wherein it can be appreciated that the upper portion of the new and improved double-acting reciprocating pump assembly is disposed within the melter section of the melter assembly while the lower portion of the new and improved double-acting reciprocating pump assembly is disposed within the combustion chamber of the melter assembly but could be isolated from the combustion chamber if desired.
Figure 2:
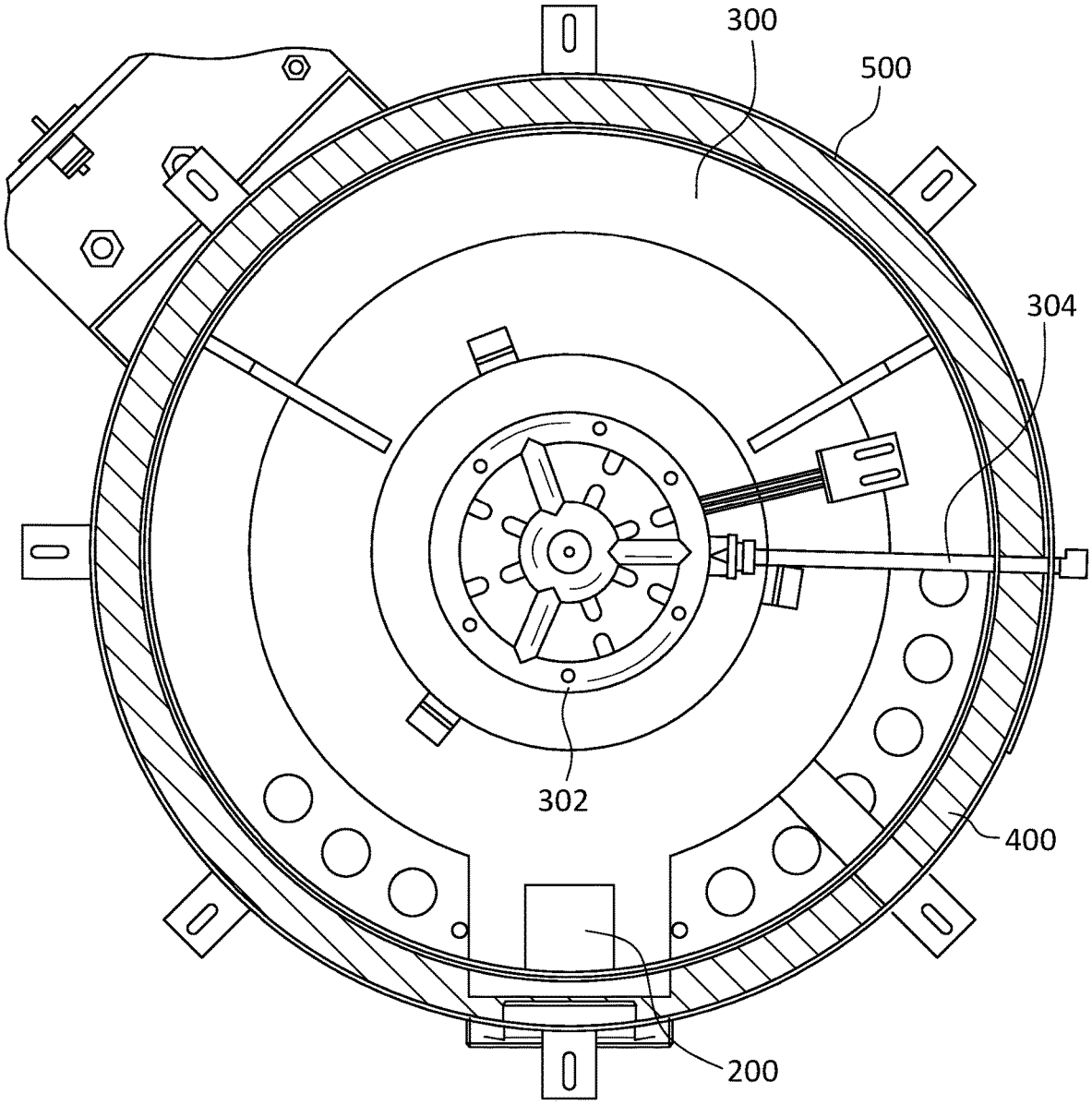
FIG. 2 is a horizontal cross-sectional, bottom plan view of the melter assembly showing the combustion burner disposed within the axially central portion of the combustion chamber with the melter assembly disposed at a radially remote offset section of the combustion chamber, and wherein flue holes are disposed in a semi-circular array at the top of the combustion chamber so as to permit exhaust gases to escape to the atmosphere.
Figure 3:
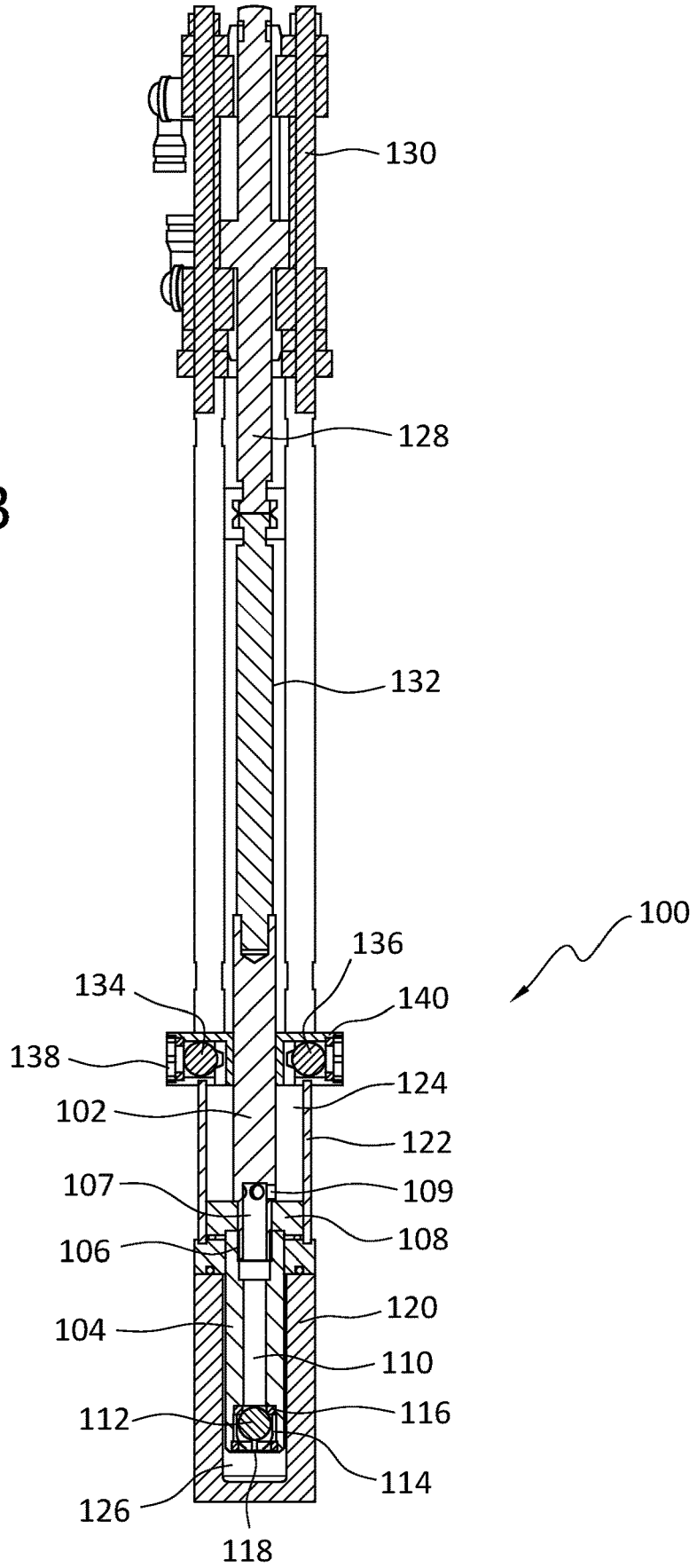
FIG. 3 is a schematic cross-sectional view of the first embodiment of the new and improved double-acting reciprocating pump assembly as shown in FIG. 1 but enlarged so as to illustrate the various components of the pump assembly, as well as the components connecting the first embodiment of the new and improved double-acting reciprocating pump to the pump motor-drive, in greater detail.

With reference now being made to the drawings, and more particularly to FIGS. 1 and 3-5, a first embodiment of a new and improved double-acting reciprocating pump assembly, as constructed in accordance with the principles and teachings of the present invention, is disclosed and is generally indicated by the reference character 100. For perspective and better understanding, and as can best be appreciated from FIGS. 1 and 2, the new and improved double-acting reciprocating pump assembly 100 is adapted to be utilized in conjunction with a melter assembly 200 which is fixedly mounted within a radially outer and offset location of a combustion chamber 300 wherein it is also appreciated, as can best be seen in FIG. 1, that the melter 200 is disposed at an elevated position within the combustion chamber 300 so as to be disposed at an elevation above the combustion chamber burner 302. The combustion chamber burner 302 is fluidically connected to a source of combustible fuel by means of a radially extending conduit 304, and as can best be appreciated from both FIGS. 1 and 2, an annular insulation chamber 400 contains suitable insulation so as to thermally isolate the combustion chamber 300 from an external peripheral housing wall 500 of the entire melter structure.

With reference now being made to FIGS. 1 and 3-5, the structure of the first embodiment of the new and improved double-acting reciprocating pump assembly 100 will now be described. More particularly, it is seen that the first embodiment of the new and improved double-acting reciprocating pump assembly 100 comprises a piston assembly which comprises a piston rod 102, and a lower pump piston 104. The lower end portion 106 of the piston rod 102 is hollow so as to define a first vertically oriented conduit 107, as will be more fully explained and appreciated hereinafter, whereby the distal end of the hollow lower end portion 106 of the piston rod 102 is fixedly secured within the upper end of the lower pump piston 104 by any suitable means, such as, for example, a threaded connection defined between an externally threaded portion, formed upon the distal end of the hollow lower end portion 106 of the piston rod 102, being threadedly disposed within an internally threaded portion defined within the upper end portion of the lower pump piston 104. In addition, the piston assembly of the pump assembly 100 further comprises an upper pump piston 108 wherein the upper pump piston 108 is fixedly secured to an external surface portion of the hollow, lower end portion 106 of the piston rod 102 by any suitable means, such as, for example, welding, an interference fit, or the like, and a plurality of holes or fluid flow ports 109 are defined within the piston rod 102 at an axial location just above the upper pump piston 108.

Continuing further, it is also seen that the lower pump piston 104 is substantially tubular so as to define therewithin a second vertically oriented fluid flow bore 110 which is fluidically connected at is upper end to the first vertically oriented conduit 107 defined within the hollow, lower distal end portion 106 of the piston rod 102, while a lower output ball check valve 112 is disposed within the lower end portion of the lower pump piston 104. The lower output ball check, valve 112 is disposed within an output ball check valve cage 114, and the output ball check valve cage 114 is provided with upper and lower output ball check valve seats 116,118 between which the output ball check valve 112 is movable so as to permit fluid to effectively flow through the pump assembly 100 in accordance with two opposite modes of action as will be explained more fully hereinafter. It is further seen that the pump assembly 100 comprises a lower pump housing 120 which effectively serves as a lower pump cylinder within which the lower pump piston 104 is reciprocally disposed, and an upper pump housing 122 which effectively defines an upper pump cylinder within which the upper pump piston 108 is reciprocally disposed.

Still further, and as will be better appreciated hereinafter, the upper pump housing 122 also defines an upper pump chamber 124, while the lower pump housing 120 also defines a lower pump chamber 126. It is further seen that the upper end of the piston rod 102 is fixedly connected to a motor drive rod 128 of a drive motor 130, which may either be a hydraulic motor or a pneumatic motor, an intermediate connecting rod 132 connecting the piston rod 102 to the motor drive rod 128 by means of any suitable connections. In addition, as can best be seen in FIGS. 4 and 5, a pair of upper ball check valves 134,136 are respectively disposed within upper ball check valve cages 138,140 in connection with which left and right ball check valve seats 142,144 and 146,148 are defined so as to permit fluid to flow through the pump assembly 100 in accordance with two opposite modes of action as will be explained more fully hereinafter. It is lastly noted that the upper pump housing 122, as well as the pair of upper ball check valves 134,136 and the pair of upper ball check valve cages 138,140 are disposed within an annular fluid supply chamber 150 which is fluidically connected to the melter assembly 200 by means of a plurality of inlet ports 152 which are disposed within a vertical array as can best be seen in FIGS. 1 and 2.

Having described substantially all of the structural components comprising the first embodiment of the new and improved double-acting reciprocating pump assembly 100, as constructed in accordance with the principles and teachings of the present invention, the operation of the same will now be described. In operation, as the piston assembly moves downwardly such that the lower pump piston 104 moves vertically downwardly within the lower pump chamber 126 defined by means of the lower pump cylinder 120, the lower pump piston will force material, disposed beneath the lower pump piston 104 and within the lower pump chamber 126 defined by means of the lower pump cylinder 120, to be dispensed out from a material dispensing outlet port 170 which shown in FIG. 5 as being coaxially disposed with respect to the axial extent of the double-acting reciprocating pump assembly 100. At the same time, pressure developed within the lower pump chamber 126, as a result of the lower pump piston 104 moving vertically downwardly within the lower pump chamber 126 defined by means of the lower pump cylinder 120, causes the lower ball check valve 112 to be seated upon its upper ball check valve seat 116. In addition, the upper pump piston 108 is likewise moving vertically downwardly within the upper pump chamber 124 as defined by means of the upper pump cylinder 122. Accordingly, such vertically downward movement of the upper pump piston 108 within the upper pump chamber 124 effectively causes vacuum or suction forces to be developed within the upper pump chamber 124 so as to cause the plurality of upper ball check valves 134,136 to be unseated from their left and right ball check valve seats 142,148, respectively, and seated upon their right and left ball check valve seats 144,146, respectively, thereby permitting material, to be dispensed, to flow through the ball check valve cages 138,140 and into the upper pump chamber 124 from the annular material supply chamber 150 which annularly surrounds the upper pump cylinder 122 and is fluidically connected to the melter by means of the fluid inlet ports 152. When the piston assembly reaches the end of its down stroke, the drive motor 130 reverses the operation of the piston assembly whereby the upper and lower pistons are now moved upwardly.

Remembering that the piston rod 102, to which the upper pump piston 108 is fixedly connected, is provided with the plurality of outlet holes or ports 109 which are disposed within the annular array around the piston rod 102 at an axial position along the piston rod 102 which is disposed immediately above the axial position at which the upper pump piston 108 is fixedly connected to the piston rod 102, then as the upper pump piston 108 moves upwardly within the upper pump chamber 124, pressure is developed within the upper pump chamber 124 so as to cause the upper inlet ball check valves 134,136 to be unseated from their right and left ball check valve seats 144,146, respectively, and be seated upon their left and right ball check valve seats 142,144, respectively. Therefore, fluid from the annular material supply chamber 150 is prevented from entering the upper pump chamber 124 and the only place the material, disposed within upper pump chamber 124, can go or flow, is through the plurality of outlet holes or ports 109 defined around the piston rod 102. In this manner, the plurality of outlet holes or ports 109 are now in fluidic communication with the first vertically oriented axial bore 107 defined within the lower end portion 106 of the piston rod 102 and, in turn, the first vertically oriented axial bore 107 is fluidically connected to the second vertically oriented axial bore 110 defined within the lower pump piston 104. This second vertically oriented axial bore 110, defined within the lower pump piston 104, terminates at the position where the lower outlet ball check valve 112 is located, and accordingly, the material to be dispensed unseats the lower outlet ball check valve 112 from its upper ball check valve seat 116 to its lower ball check valve seat 118 such that the material to be dispensed can flow through the lower ball check valve cage 114 and out from the material dispensing outlet port 170.

It is to be noted in conjunction with the operation of the new and improved double-acting reciprocating pump assembly that the square surface area of the upper face of the upper piston 108, operating upon the fluid material disposed within the upper pump chamber 124 during the upstroke of the piston assembly, is twice the size of the square surface area of the lower face of the lower pump piston 104 operating upon the fluid material disposed within the lower pump chamber 126 during the downstroke of the piston assembly. This permits the same volume of material to be dispensed from the new and improved double-acting reciprocating pump assembly 100 during both the up and down strokes of the new and improved double-acting reciprocating pump assembly 100 because during the upstroke of the piston assembly, one half of the material forcefully discharged from the upper pump chamber 124 is eventually dispensed out from the material dispensing outlet port while the other half of the material being discharged effectively refills the lower pump chamber 126 as the lower pump piston 104 is retracted upwardly within the lower pump chamber 126. It is further noted that since the plurality of inlet ball check valves 134,136 are fluidically connected to the material supply chamber 150 annularly surrounding the upper pump cylinder 122 and the plurality of inlet ball check valves 134,136, any leakage of material from the upper piston-cylinder assembly that may occur will effectively occur within the material supply chamber 150 whereby such leaked fluid will effectively be contained within the annular material supply chamber 150 so as not to cause any external leakage problems which may adversely affect other structural components of the overall melter assembly. It is lastly noted that the first embodiment of the new and improved double-acting reciprocating pump assembly 100 of the present invention can be utilized to pump and dispense both hot and cold materials, and in the case of hot materials, the fluids can be at temperatures of up to 500° F.

Figure 6:
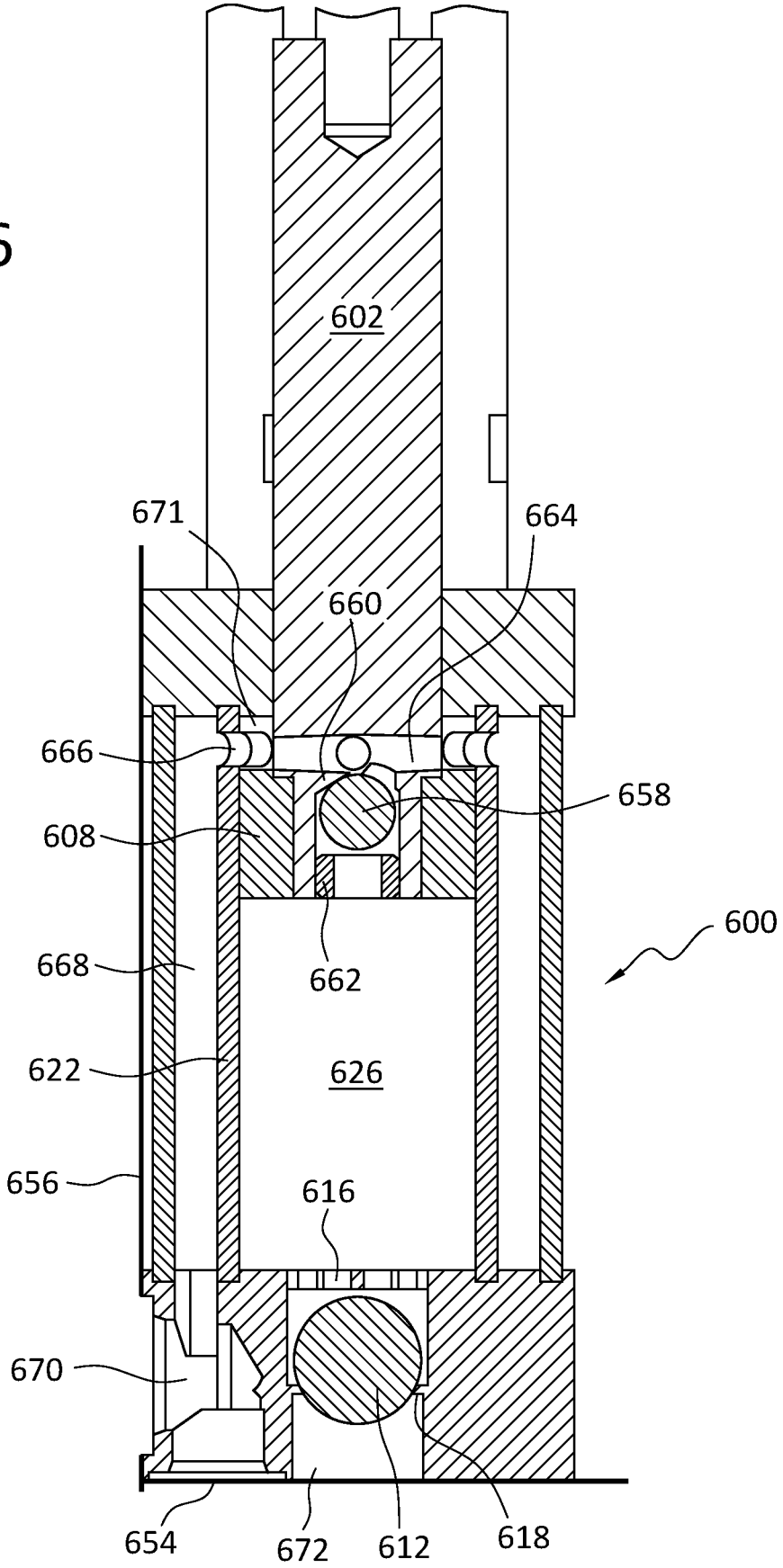
FIG. 6 is a schematic enlarged cross-sectional view of a second embodiment of a new and improved double-acting reciprocating pump as constructed in accordance with the principles and teachings of the present invention, wherein only a single piston assembly is illustrated wherein the piston is disposed near its UP position and is just beginning its down stroke.

With reference now being made to FIG. 6, a second embodiment of a new and improved double-acting reciprocating pump assembly, as constructed in accordance with the principles and teachings of the present invention, is disclosed and is generally indicated by the reference character 600. It is to be noted that while the structural assembly of the second embodiment of the new and improved double-acting reciprocating pump assembly 600 of the present invention is somewhat different from the structural assembly of the first embodiment of the new and improved double-acting reciprocating pump assembly 100 of the present invention, the overall operation of the second embodiment of the new and improved double-acting reciprocating pump assembly 600 of the present invention is generally similar to the overall general operation of the first embodiment of the new and improved double-acting reciprocating pump assembly 100 of the present invention. Accordingly, the detailed description of the various components of the second embodiment of the new and improved double-acting reciprocating pump assembly 600 which correspond to structural components of the first embodiment of the new and improved double-acting reciprocating pump assembly 100 of the present invention will be denoted by reference characters similar to those of the first embodiment of the new and improved double-acting reciprocating pump assembly 100 of the present invention except that they will be within the 600 series.

More particularly, it is initially noted, for example, that the entire double-acting reciprocating pump assembly 600 is disposed within the melter as schematically illustrated by means of the bottom or floor 654 of the melter and a side wall 656 of the melter. In addition, it is further noted that there is only a single piston 608 disposed within a single piston cylinder 622, and that the single piston 608 is fixedly secured to a piston rod 602 whereby the single piston 608 moves reciprocally within the single piston cylinder 622 so as to effectively divide the cylinder into an upper pump chamber and a lower pump chamber, only the lower pump chamber 626 being visible within FIG. 6 since the single piston 608 is disposed at its uppermost position. An upper ball check valve 658 is disposed within the single piston 608 and has upper and lower ball check valve seats 660,662 operatively associated therewith, while a lower ball check valve 612 is disposed within a bottom portion of the piston-cylinder assembly and likewise has upper and lower ball check valve seats 616,618 operatively associated therewith. In operation, when the single piston 608 moves downwardly, the lower ball check valve 612 is seated upon its lower ball check valve seat 618 due to the downward pressure exerted upon the fluid disposed within the lower pump chamber 626, while the fluid, to be dispensed, simultaneously forces the upper ball check valve 658 to be unseated from its lower ball check valve seat 662 and be seated upon its upper ball check valve seat 660 whereby the fluid can flow around the unseated upper ball check valve 658, into one or more cross-channels 664 defined within the piston rod 602, out through a plurality of outlet ports 666 defined within upper end portions of the single piston cylinder 622, and through an annular passageway 668 defined around the single piston cylinder 622 which leads to a radially oriented fluid dispensing outlet port 670 defined within a lower end portion of the double-acting reciprocating pump assembly 600.

Conversely, when the single piston 608 moves upwardly within the single piston cylinder 622, the lower ball check valve 612, fluidically connected to the interior of the melter through means of a fluid inlet port 672 defined within the bottom of the piston-cylinder assembly, will be unseated from its lower check ball valve seat 618 and moved into position upon its upper check ball valve seat 616 so as to permit fluid to flow around the lower ball check valve 612 and enter the lower pump chamber 626, while the upper ball check valve 658 will be forced to be seated upon its upper check ball valve seat 660 as a result of the pressure developed within the upper pump chamber as a result of the single piston 608 moving upwardly within the single piston cylinder 622. The fluid within the upper pump chamber is then forced outwardly through the aforenoted cross-channels 664 defined within the piston rod 602, as well as through the outlet ports 666 defined within the single piston cylinder 622 so as to enter the annular passageway or fluid conduit 668 surrounding the single piston cylinder 622 whereby the fluid can be dispensed outwardly through the fluid dispensing outlet port 670. As was the case with the first embodiment, it is noted that the square surface area of the lower face of the single piston 608 is twice the size of the square surface area of the upper face of the single piston 608 which effectively merges with the piston rod 602. In this manner, when the single piston 608 is moving downwardly, half of the fluid being forced outwardly from the lower pump chamber 626 flows around the unseated upper ball check valve 658, through the aforenoted cross-channels 664 defined within the piston rod 602, as well as the outlet ports 666 defined within the single piston cylinder 622, through the annular passageway 668 surrounding the single piston cylinder 622, and out through the fluid dispensing outlet port 670, while the other half of the fluid is effectively utilized to refill the upper pump chamber 671. This permits the same volume of material to be dispensed from the third embodiment of the pump assembly 600 of the present invention during both the up and down strokes of the piston assembly. It is noted that having the fluid inlet 672 disposed within the bottom of the melter permits the fluid contents of the melter to effectively be substantially completely used or depleted.

Figure 7:
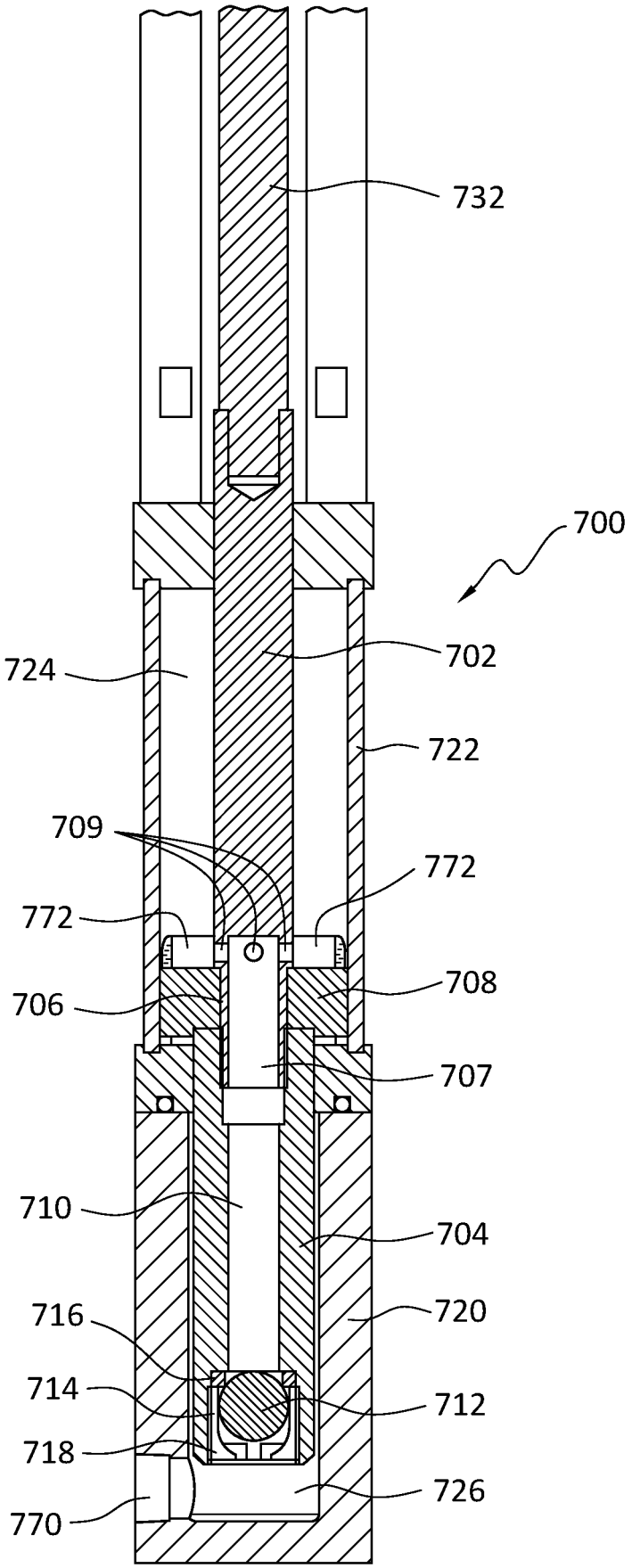
FIG. 7 is a schematic enlarged cross-sectional view of a third embodiment of a new and improved double-acting reciprocating pump as constructed in accordance with the principles and teachings of the present invention, wherein the third embodiment of the new and improved double-acting reciprocating pump is similar to the first embodiment of the new and improved double-acting reciprocating pump, as illustrated within FIGS. 1 and 3-5, except that the upper pair of ball check valves have been eliminated.

Lastly, with reference now being made to FIG. 7, a third embodiment of a new and improved double-acting reciprocating pump assembly, as constructed in accordance with the principles and teachings of the present invention, is disclosed and is generally indicated by the reference character 700. It is to be noted that while the structural assembly of this third embodiment of the new and improved double-acting reciprocating pump assembly 700 of the present invention is somewhat different from the structural assembly of the first embodiment of the new and improved double-acting reciprocating pump assembly 100 of the present invention, the overall operation of the third embodiment of the new and improved double-acting reciprocating pump assembly 700 of the present invention is generally similar to the overall general operation of the first embodiment of the new and improved double-acting reciprocating pump assembly 100 of the present invention. Accordingly, the detailed description of the various components of the third embodiment of the new and improved double-acting reciprocating pump assembly 700 which correspond to structural components of the first embodiment of the new and improved double-acting reciprocating pump assembly 100 of the present invention will be denoted by reference characters similar to those of the first embodiment of the new and improved double-acting reciprocating pump assembly 100 of the present invention except that they will be within the 700 series.

More particularly, while the structural assembly of the third embodiment of the new and improved double-acting reciprocating pump assembly 700 of the present invention is somewhat similar to the structural assembly of the first embodiment of the new and improved double-acting reciprocating pump assembly 100 of the present invention in that the third embodiment of the new and improved double-acting reciprocating pump assembly 700 of the present invention utilizes an upper pump piston 708 disposed within an upper pump cylinder 722 defining an upper pump chamber 724, and a lower pump piston 704 disposed within a lower pump cylinder 720 which defines a lower pump chamber 726, the upper ball check valves 134, 136 of the first embodiment of the new and improved double-acting reciprocating pump assembly 100 of the present invention have been eliminated. Also, in a manner similar to that of the first embodiment of the new and improved double-acting reciprocating pump assembly 100 of the present invention, the upper pump piston 708 is fixedly attached to a piston rod 702 which is, in turn, fixedly connected to a motor rod of a drive motor, not shown in this figure, through means of an intermediary connecting rod 732, which drives the pump assembly in a vertically reciprocal manner, while the lower end portion 706 of the piston rod 702 is fixedly connected to the upper end portion of the lower pump piston 704. Again, the drive motor may be pneumatic, electric, or hydraulic.

Figure 4:
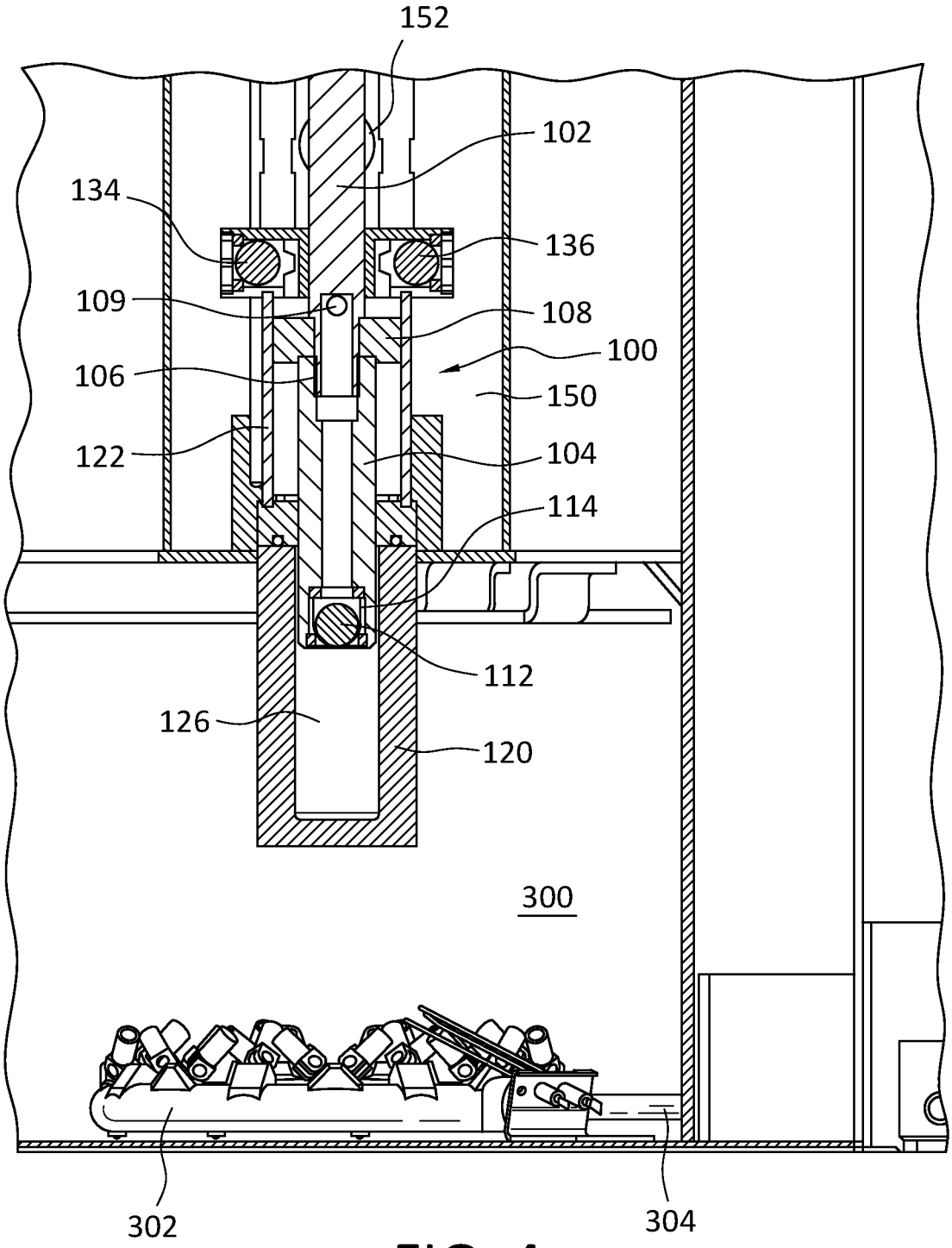
FIG. 4 is an enlarged schematic side cross-sectional view of the first embodiment of the new and improved double-acting reciprocating pump assembly, as disclosed within FIG. 1, except that the pump is disposed at its UP position and is just beginning to move downwardly.
Figure 5:
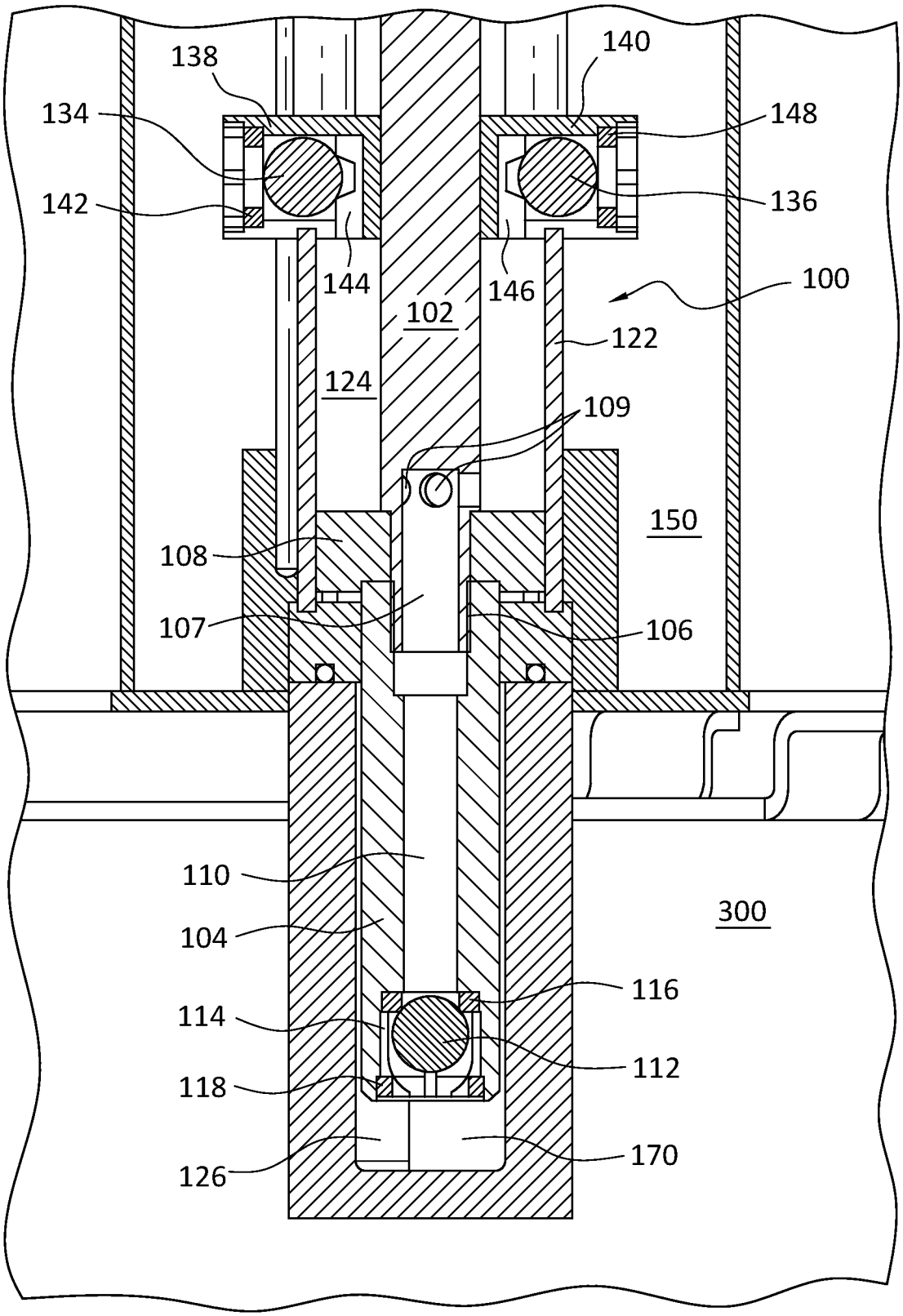
FIG. 5 is a schematic side cross-sectional view of the first embodiment of the new and improved double-acting reciprocating pump assembly, as disclosed within FIG. 1, enlarged to an even greater extent.

In addition, an annular array of fluid inlet ports 772 are formed within the lower part of the upper piston cylinder 722, at an axial position just above the upper pump piston 708 when the upper pump piston 708 is located at the bottom of its down stroke, such that the interior of the upper piston cylinder 722, and therefore the upper pump chamber 724 defined by the upper piston cylinder 722, is in fluidic communication with the material supply chamber, not shown but similar to the material supply chamber 150 shown in FIG. 4 in connection with the first embodiment of the new and improved double-acting reciprocating pump assembly 100, annularly surrounding the upper piston cylinder 722. As was the case with the first embodiment of the new and improved double-acting reciprocating pump assembly 100 of the present invention, a lower ball check valve 712 is disposed within a lower end portion of the lower pump piston 704 and serves as a lower outlet ball check valve which is disposed within a lower ball check valve cage 714 which comprises an upper ball check valve seat 716 and a lower ball check valve seat 718. A material dispensing outlet port 770 is fluidically connected to the lower end of the lower pump chamber 704 and is adapted to be connected to any suitable dispensing device such that when the lower outlet ball check valve 712 is seated upon one of its upper and lower valve seats 716,718, material can flow out the material dispensing outlet port 770 and be dispensed by means of the dispensing device.

In operation, when the piston assembly moves downwardly, the lower ball check valve 712 is seated upon its upper valve seat 716 due to the pressure exerted upon the fluid disposed within the lower pump chamber 726 by means of the lower pump piston 704, while at the same time, the fluid disposed within the lower pump chamber 726 is forced out through the fluid dispensing output port 770. As the piston assembly nears the end of its downward stroke, the upper pump piston 708 clears the plurality of fluid inlet ports 772 such that fluid can now enter the upper pump chamber 724 so as to refill the same with fluid to be dispensed. Accordingly, and conversely, as the piston assembly begins to move upwardly, the upper pump piston 708 closes off the annular array of fluid inlet ports 772 and forces the fluid disposed within the upper pump chamber 724 to enter the annular array of fluid outlet ports 709 defined within the piston rod 702. The fluid outlet ports 709 are fluidically connected to an axial passageway 707 defined within the lower end portion of the piston rod 702 as well as to an axial passageway 710 defined within the lower pump piston 704, whereby the fluid flowing through the axial passageway 710 causes the lower ball check valve to be unseated from its upper ball check valve seat 716 and be seated upon its lower ball check valve seat 718 so as to permit the fluid to flow around the ball check valve 712, through the ball check valve cage 714, and out through the dispensing outlet port 770.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent, is:

1. A double-acting reciprocating pump assembly for dispensing a fluid, comprising: a piston assembly comprising at least one piston disposed within at least one piston cylinder, defined around a longitudinal axis and having a predetermined length dimension, wherein said at least one piston undergoes opposite reciprocal movements within said at least one piston cylinder along said longitudinal axis; an upper pump chamber disposed above said at least one piston, and a lower pump chamber disposed below said at least one piston; a fluid inlet port fluidically connected to a material supply of fluid to be dispensed and fluidically connected to one of said upper and lower pump chambers so as to supply the fluid to be dispensed to said one of said upper and lower pump chambers; a fluid conduit fluidically connected to one of said upper and lower pump chambers, extending longitudinally throughout said predetermined length dimension of said at least one piston cylinder, and disposed coaxially with respect to said at least one piston cylinder defined around said longitudinal axis; and a fluid outlet dispensing port defined within a lower end portion of said double-acting reciprocating pump assembly and fluidically connected to said fluid conduit for permitting the fluid to be dispensed out from said double-acting reciprocating pump assembly during both of said opposite reciprocal movements.

2. The double-acting reciprocating pump assembly as set forth in claim 1, wherein:

said double-acting reciprocating pump assembly is disposed within a melter whereby the fluid to be dispensed is material melted within said melter.

3. The double-acting reciprocating pump assembly as set forth in claim 1, wherein: said fluid inlet port fluidically connected to said material supply is fluidically connected to said lower pump chamber so as to supply the fluid to be dispensed into said lower pump chamber; and said fluid outlet dispensing port is defined within said lower end portion of said double-acting reciprocating pump assembly so as to be disposed said piston cylinder for permitting fluid to be dispensed out from said double-acting reciprocating pump assembly during both of said opposite reciprocal movements.

4. The double-acting reciprocating pump assembly as set forth in claim 3, wherein:

a first ball check valve is operatively associated with said fluid inlet port and has a pair of ball check valve valve seats so as to control fluid into and out from said lower pump chamber;

a second ball check valve is mounted within said piston and has a pair of ball check valve valve seats so as to control fluid flow into and out from said upper pump chamber.

5. The double-acting reciprocating pump assembly as set forth in claim 4, wherein: said fluid conduit annularly surrounds said at least one piston cylinder; said piston is fixedly connected to a piston rod; said piston rod is provided with at least one cross-channel fluidically connected to said annular fluid conduit; and said first ball check valve operatively associated with said fluid inlet port is also operatively associated with said lower pump chamber, and said pair of check valve valve seats associated with said first ball check valve is comprised of upper and lower ball check valve valve seats, while said pair of check valve valve seats associated with said second ball check valve mounted within said piston is comprised of upper and lower ball check valve valve seats, whereby when said piston assembly moves downwardly, said first ball check valve operatively associated with said lower pump chamber will be seated upon said lower ball check valve valve seat so as to prevent fluid from flowing out from said lower pump chamber, said piston moves downwardly within said piston cylinder so as to force fluid, disposed within said lower pump chamber to unseat said second check valve, mounted within said piston, from the lower ball check valve valve seat to the upper ball check valve valve seat so as to permit fluid to flow through said at least one cross-channel defined within said piston rod, through said annular chamber surrounding said piston cylinder, and out through said fluid outlet dispensing port, whereas when said piston assembly moves upwardly, said first ball check valve operatively associated with said lower pump chamber will be unseated from said lower check ball valve valve seat and be seated upon said upper check ball valve valve seat so as to permit fluid to enter said lower pump chamber, while said second ball check valve mounted within said piston will be seated upon said lower ball check valve valve seat so as to prevent fluid from said upper pump chamber to flow into said lower pump chamber while permitting fluid from said upper pump chamber to flow through said at least one cross-channel defined within said piston rod, through said annular chamber surrounding said piston cylinder, and out through said fluid outlet dispensing port.

6. The double-acting reciprocating pump assembly as set forth in claim 3, wherein: a lower face portion of said piston has a lower face square area twice the size of an upper face square area of the upper face portion of said piston such that when said piston assembly moves downwardly, one half of the fluid discharged from said lower pump chamber is dispensed out from said fluid outlet dispensing port while one half of the fluid discharged from said lower pump chamber is used to refill said upper pump chamber, whereby the same amount of fluid is dispensed from said double-acting reciprocating pump assembly as said piston assembly moves upwardly and downwardly.

7. The double-acting reciprocating pump assembly as set forth in claim 3, wherein:

said at least one piston cylinder is provided with a plurality of fluid outlet ports.

* * * * *